US009869943B2

(12) United States Patent
Aoki et al.

(10) Patent No.: US 9,869,943 B2
(45) Date of Patent: Jan. 16, 2018

(54) METHOD OF PRODUCING TONER AND METHOD OF PRODUCING RESIN PARTICLE

(71) Applicant: CANON KABUSHIKI KAISHA, Tokyo (JP)

(72) Inventors: Kenji Aoki, Mishima (JP); Yusuke Kosaki, Susono (JP); Tetsuya Kinumatsu, Mishima (JP); Shuntaro Watanabe, Hadano (JP); Noritaka Toyoizumi, Mishima (JP); Atsushi Tani, Suntou-gun (JP); Takashige Kasuya, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/291,163

(22) Filed: Oct. 12, 2016

(65) Prior Publication Data

US 2017/0123331 A1 May 4, 2017

(30) Foreign Application Priority Data

Oct. 29, 2015 (JP) ..... 2015-213166

(51) Int. Cl.
*G03G 9/08* (2006.01)
*G03G 9/087* (2006.01)

(52) U.S. Cl.
CPC ..... *G03G 9/0804* (2013.01); *G03G 9/0819* (2013.01); *G03G 9/0825* (2013.01); *G03G 9/08711* (2013.01); *G03G 9/08755* (2013.01)

(58) Field of Classification Search
CPC ..... G03G 9/0804
See application file for complete search history.

(56) References Cited

U.S. PATENT DOCUMENTS 5,298,354 A 3/1994 Matsunaga et al.
5,300,386 A 4/1994 Kanbayashi et al.
(Continued)

FOREIGN PATENT DOCUMENTS

JP 2009-052005 3/2009
JP 2011-246691 12/2011
(Continued)

*Primary Examiner* — Hoa V Le
(74) *Attorney, Agent, or Firm* — Fitzpatrick Cella Harper and Scinto

(57) ABSTRACT

A method of producing a toner containing a toner particle, including the steps of: a) preparing a resin solution by mixing a resin A and an organic solvent, b) mixing the resin solution, a resin fine particle containing a resin B, and a dispersion medium to form a droplet of the resin solution whose surface has been covered with the resin fine particle, and c) removing the organic solvent in the droplet, in which the resin B is a polymer of a monomer composition containing a monomer X having polymerizable unsaturated groups at the both ends; the monomer X has a peak molecular weight of 5,000 to 50,000; the content of the monomer X is 0.10% to 3.00% by mol; and the following formula (1) is satisfied, $$|SP_X - SP_A| \leq 2.0 \quad (1)$$

where $SP_A$ and $SP_X$ represent solubility parameters of the resin A and the monomer X, respectively.

10 Claims, 1 Drawing Sheet

(56) References Cited

U.S. PATENT DOCUMENTS

| | | | |
|---|---|---|---|
| 5,407,776 | A | 4/1995 | Kanbayashi et al. |
| 5,478,686 | A | 12/1995 | Kawakami et al. |
| 5,500,321 | A | 3/1996 | Kasuya et al. |
| 5,529,873 | A | 6/1996 | Chiba et al. |
| 5,558,967 | A | 9/1996 | Nagatsuka et al. |
| 5,571,653 | A | 11/1996 | Kasuya et al. |
| 5,578,407 | A | 11/1996 | Kasuya et al. |
| 5,663,026 | A | 2/1997 | Kasuya et al. |
| 5,691,093 | A | 11/1997 | Kanbayashi et al. |
| 5,700,616 | A | 12/1997 | Kasuya et al. |
| 5,712,073 | A | 1/1998 | Katada et al. |
| 5,840,457 | A | 11/1998 | Urawa et al. |
| 5,972,553 | A | 10/1999 | Katada et al. |
| 6,002,895 | A | 12/1999 | Kasuya et al. |
| 6,214,509 | B1 | 4/2001 | Kasuya et al. |
| 6,300,024 | B1 | 10/2001 | Yusa et al. |
| 6,485,875 | B1 | 11/2002 | Karaki et al. |
| 6,703,176 | B2 | 3/2004 | Naka et al. |
| 6,875,549 | B2 | 4/2005 | Yamazaki et al. |
| 6,881,527 | B2 | 4/2005 | Moribe et al. |
| 7,014,969 | B2 | 3/2006 | Yachi et al. |
| 7,097,951 | B2 | 8/2006 | Moribe et al. |
| 7,150,953 | B2 | 12/2006 | Yamazaki et al. |
| 7,273,686 | B2 | 9/2007 | Onuma et al. |
| 7,288,354 | B2 | 10/2007 | Moribe et al. |
| 7,402,368 | B2 | 7/2008 | Ogawa et al. |
| 7,422,832 | B2 | 9/2008 | Ogawa et al. |
| 7,452,649 | B2 | 11/2008 | Magome et al. |
| 7,537,877 | B2 | 5/2009 | Yoshiba et al. |
| 7,582,401 | B2 | 9/2009 | Ogawa et al. |
| 7,678,524 | B2 | 3/2010 | Hasegawa et al. |
| 7,700,254 | B2 | 4/2010 | Moribe et al. |
| 7,704,659 | B2 | 4/2010 | Ogawa et al. |
| 7,811,734 | B2 | 10/2010 | Ogawa et al. |
| 7,935,771 | B2 | 5/2011 | Fukui et al. |
| 7,939,231 | B2 | 5/2011 | Ogawa et al. |
| 8,084,174 | B2 | 12/2011 | Hasegawa et al. |
| 8,093,342 | B2 | 1/2012 | Minami et al. |
| 8,110,329 | B2 | 2/2012 | Tominaga et al. |
| 8,178,275 | B2 | 5/2012 | Tani et al. |
| 8,372,573 | B2 | 2/2013 | Ayaki et al. |
| 8,383,312 | B2 | 2/2013 | Fujimoto et al. |
| 8,465,896 | B2 | 6/2013 | Sekikawa et al. |
| 8,475,987 | B2 | 7/2013 | Kaya et al. |
| 8,497,056 | B2 | 7/2013 | Sekikawa et al. |
| 8,551,680 | B2 | 10/2013 | Ayaki et al. |
| 8,603,712 | B2 | 12/2013 | Aoki et al. |
| 8,652,725 | B2 | 2/2014 | Watanabe et al. |
| 8,741,519 | B2 | 6/2014 | Watanabe et al. |
| 8,785,101 | B2 | 7/2014 | Kaya et al. |
| 8,846,284 | B2 | 9/2014 | Kinumatsu et al. |
| 8,975,000 | B2 | 3/2015 | Tani et al. |
| 9,057,971 | B2 * | 6/2015 | Watanabe ..... G03G 9/0802 |
| 9,176,410 | B2 | 11/2015 | Tani et al. |
| 9,309,349 | B2 | 4/2016 | Watanabe et al. |
| 9,429,860 | B2 | 8/2016 | Kinumatsu et al. |
| 2002/0055053 | A1 | 5/2002 | Kasuya et al. |
| 2004/0110076 | A1 | 6/2004 | Yamazaki et al. |
| 2010/0035171 | A1 | 2/2010 | Watanabe et al. |
| 2016/0187797 | A1 | 6/2016 | Kosaki et al. |
| 2016/0187798 | A1 | 6/2016 | Toyoizumi et al. |
| 2016/0282740 | A1 | 9/2016 | Aoki et al. |
| 2016/0291494 | A1 | 10/2016 | Kinumatsu et al. |
| 2017/0003610 | A1 | 1/2017 | Kosaki et al. |
| 2017/0003612 | A1 | 1/2017 | Toyoizumi et al. |

FOREIGN PATENT DOCUMENTS

| | | |
|---|---|---|
| JP | 2013-011884 | 1/2013 |
| JP | 2013-137535 | 7/2013 |

* cited by examiner

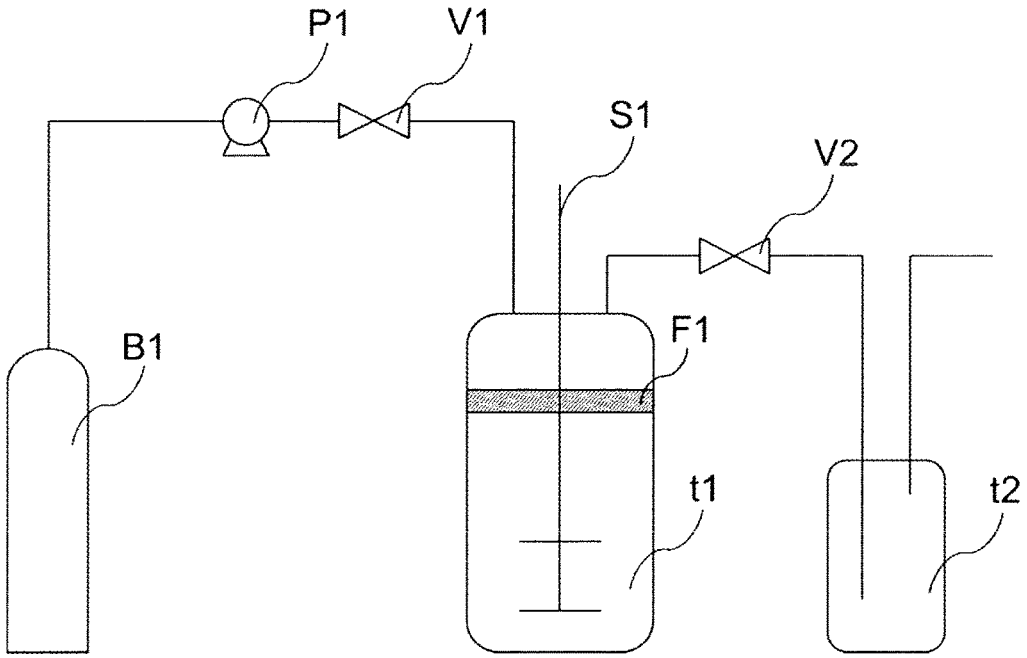
P1
V1
S1
V2
B1
F1
t1
t2

METHOD OF PRODUCING TONER AND METHOD OF PRODUCING RESIN PARTICLE

BACKGROUND OF THE INVENTION

Field of the Invention

The present invention relates to a method of producing a toner and a method of producing a resin particle.

Description of the Related Art

Resin particles are used in a wide variety of fields including paints, inks and toners. In any field, controlling the size of resin particles and particle size distribution is regarded as important. In particular, a resin particle having not only a smaller size but also a narrow particle size distribution has been desired. Of these fields, particularly in the field of toners, development of a toner providing a further improved image in quality is desired and toner particles uniform in performance are desired. To satisfy the desires, it is effective to produce toner particles reduced in size and mutually uniform with a narrow particle size distribution. As a method of relatively easily narrowing the particle size distribution of a toner particle, a dissolution-suspension method is exemplified. The dissolution suspension method is a method of obtaining a resin particle by dissolving a resin in an organic solvent in advance to prepare a resin solution and dispersing the resin solution in a dispersion medium to form droplets of the resin solution, followed by removing the organic solvent. In order to prepare a resin particle with a narrow particle size distribution by the dissolution suspension method, it is effective to use a dispersant. The dispersant covers the surface of droplets of a resin-solution to suppress aggregation and sedimentation of the droplets. Likewise, the dispersant contributes to stable dispersion of the droplets and plays a role of maintaining a dispersion state until an organic solvent is removed.

Japanese Patent Application Laid-Open No. 2009-052005 proposes a method of producing a resin particle by using liquid-state or supercritical-state carbon dioxide as a dispersion medium and a resin fine particle as a dispersant. The resin fine particle used in this method is formed of behenyl acrylate and a methacryl-modified silicone. Japanese Patent Application Laid-Open No. 2013-137535 proposes a method of producing a toner in a dispersion medium containing carbon dioxide, by using a resin fine particle containing a resin having a comb-like structure, which is constituted of a unit having an organopolysiloxane structure and a unit having an aliphatic polyester structure.

SUMMARY OF THE INVENTION

The present inventors produced a toner based on the description of Japanese Patent Application Laid-Open No. 2009-052005; however, they found that a resin particle reduced in size with a satisfactory particle size distribution is not always obtained. The resin fine particle used in this method has low affinity for a resin solution and dissociates until the resin solution is removed. Presumably, dispersion stability cannot be maintained.

In contrast, in the method described in Japanese Patent Application Laid-Open No. 2013-137535, a toner particle having a satisfactory particle size distribution was successfully obtained at a temperature as low as about 25° C. However, in order to further improve the particle size distribution, the present inventors formed droplets by heating the resin solution to reduce the viscosity. As a result, it was found that coarse particles are likely to be generated and the particle size distribution tends to be widened. They investigated on the cause of this phenomenon. As a result, it was found that the resin fine particle used herein has a little low resistant to an organic solvent of high temperature. A further improvement is desired.

The present invention was made in view of these problems and is directed to stably providing a toner having a toner particle which is small in size with a narrow particle size distribution, and stably providing a resin particle which is small in size with a narrow particle size distribution.

According to one aspect of the present invention, there is provided a method of producing a toner having a toner particle, including the steps of:

a) preparing a resin solution by mixing a resin A and an organic solvent, b) mixing the resin solution, a resin fine particle containing a resin B, and a dispersion medium to form a droplet of the resin solution whose surface has been covered with the resin fine particle, and c) removing the organic solvent in the droplet, in which the resin B is a polymer of a monomer composition containing a monomer X having polymerizable unsaturated groups at the both ends;

the monomer X has a peak molecular weight of 5,000 or more and 50,000 or less;

the content of the monomer X is 0.10% by mol or more and 3.00% by mol or less based on the total amount of monomers of the monomer composition; and the resin A and the monomer X satisfy the following formula (1), $$|SP_X - SP_A| \leq 2.0 \quad (1)$$

where $SP_A$ represents a solubility parameter of the resin A, and $SP_X$ represents a solubility parameter of the monomer X.

According to another aspect of the present invention, there is provided a method of producing a resin particle, including the steps of:

a) preparing a resin solution by mixing a resin A and an organic solvent, b) mixing the resin solution, a resin fine particle containing a resin B, and a dispersion medium to form a droplet of the resin solution whose surface has been covered with the resin fine particle, and c) removing the organic solvent in the droplet, in which the resin B is a polymer of a monomer composition containing a monomer X having polymerizable unsaturated groups at the both ends;

the monomer X has a peak molecular weight of 5,000 or more and 50,000 or less;

the content of the monomer X is 0.10% by mol or more and 3.00% by mol or less based on a total amount of monomers of the monomer composition; and the resin A and the monomer X satisfy the above formula (1).

Further features of the present invention will become apparent from the following description of exemplary embodiments with reference to the attached drawing.

BRIEF DESCRIPTION OF THE DRAWING

FIGURE is a schematic view of an apparatus for producing a toner used in Examples of the invention.

DESCRIPTION OF THE EMBODIMENTS

Preferred embodiments of the present invention will now be described in detail in accordance with the accompanying drawing.

[Method of Producing a Toner]

The present invention is a method of producing a toner having a toner particle, including the following steps a), b) and c):

a) preparing a resin solution by mixing a resin A and an organic solvent, b) mixing the resin solution, a resin fine particle containing a resin B, and a dispersion medium to form a droplet of the resin solution whose surface has been covered with the resin fine particle and c) removing the organic solvent in the droplet.

The resin B is a polymer obtained by polymerizing a monomer composition containing a monomer X having polymerizable unsaturated groups at the both ends. The peak molecular weight (Mp) of the monomer X is 5,000 or more and 50,000 or less. The content of the monomer X is 0.10% by mol or more and 3.00% by mol or less based on the total amount of monomers of the monomer composition. The resin A and the monomer X satisfy the following formula (1).

$$|SP_X - SP_A| \leq 2.0 \quad (1)$$

where $SP_A$ represents a solubility parameter of the resin A, and $SP_X$ represents a solubility parameter of the monomer X.

In the step a) (hereinafter also referred to as Step a)), a resin A, an organic solvent, optionally a colorant, a wax and other additives are mixed, and uniformly dissolved or dispersed by a disperser to prepare a resin solution. Examples of the disperser include a homogenizer, a ball mill, a colloid mill and an ultrasonic dispersing machine.

In the step b) (hereinafter also referred to as Step b)), the resin solution, a resin fine particle containing a resin B, and a dispersion medium are mixed to form a droplet of the resin solution whose surface has been covered with the resin fine particle. At this time, the resin fine particle serves as a dispersant. Since the resin fine particle covers the surface of droplets of the resin solution to suppress aggregation and sedimentation of the droplets, with the result that droplets are stably dispersed and maintained in a dispersion state until the organic solvent is removed.

The resin fine particle is required to satisfy the following two conditions. A first condition is that, in order for the resin fine particle to behave as a solid, the resin fine particle must be present without being dissolved in the organic solvent or the dispersion medium; in short, "solvent resistant". A second condition is that, in order for the resin fine particle to be constantly present at the boundary face (interfacial surface) between the resin solution and the dispersion medium, the resin fine particle must have affinity for the resin solution; in short, "interface localization". However, if solvent resistance is ensured, the resin fine particle becomes rigid and deteriorates in flexibility. As a result, the affinity of the resin fine particle for the resin solution decreases and a degree of interface localization decreases. Accordingly, to ensure both solvent resistance and interface localization, ingenious contrivance of the resin fine particle is required.

As a result of intensive studies, the present inventors found that, if a resin fine particle contains a resin B, which has a predetermined distance between crosslinking sites and constant affinity for the resin solution, the resin fine particle can acquire both solvent resistance and interface localization. As a result, a toner having a toner particle reduced in size with a narrow particle size distribution can be stably provided. In other words, a toner having a toner particle reduced in amount of coarse particle with a narrow particle size distribution can be stably provided.

In the step c) (hereinafter also referred to as Step c)), the organic solvent in the droplets is removed. The organic solvent can be removed, for example, by further adding a dispersion medium to a dispersion medium having a droplet dispersed therein to extract the organic solvent into the dispersion medium added and replacing the dispersion medium containing the organic solvent with a dispersion medium. Alternatively, if a gas such as nitrogen or air is supplied, the remaining organic solvent can be evaporated into the gas.

(Resin A)

In the present invention, provided that the solubility parameter of a resin A is represented by $SP_A$; whereas the solubility parameter of a monomer X (described later) is represented by $SP_X$, $SP_A$, and $SP_X$ satisfy the following formula (1).

$$|SP_X - SP_A| \leq 2.0 \quad (1)$$

SP is also referred to as solubility parameter, which is used as an index of solubility, indicating how much a material can be dissolved in another material. Materials having close SP values are sufficiently dissolved with each other; whereas materials having distant SP values are insufficiently dissolved with each other. SP (solubility parameter) is computationally obtained by solubility-parameter calculation software (Hansen Solubility Parameters in Practice).

If $SP_A$ and $SP_X$ satisfy the Formula (1), affinity between the resin A and the monomer X, in other words, affinity between the resin solution and the resin B, can be ensured. Accordingly, a degree of interface localization is improved and the particle size distribution is narrowed. In contrast, if a value of $|SP_X - SP_A|$ is larger than 2.0, a degree of interface localization decreases and the particle size distribution is broaden. The value of $|SP_X - SP_A|$ is preferably 1.8 or less, more preferably 1.7 or less and further preferably 1.5 or less. Note that, the lower limit of the range of $|SP_X - SP_A|$, which is not particularly limited, is theoretically 0 or more.

The resin A is not particularly limited as long as the resin A satisfies the above Formula (1); however, the resin A can contain a crystalline resin. In order to ensure affinity of resin A for the resin fine particle, resin A can contain a polyester. The crystalline resin shows a distinctive melting point (peak) in differential scanning calorimetry measurement using a differential scanning calorimeter (DSC). If a crystalline resin is contained, the viscosity of molten resin A decreases and satisfactory fixability at low temperature is obtained. The melting point of the crystalline resin can be 50.0° C. or more and 80.0° C. or less. Examples of the crystalline resin include a crystalline polyester, a crystalline alkyl resin, a crystalline polyurethane and a crystalline polyurea. These crystalline resins may be used alone or in combination of two or more. Of these crystalline resins, a crystalline polyester can be used. If a resin A contains a crystalline polyester, affinity of a resin A for a monomer X improves.

The crystalline polyester is obtained preferably by reacting an aliphatic diol and an aliphatic dicarboxylic acid, and more preferably by reacting an aliphatic diol having 3 to 10 carbon atoms and an aliphatic dicarboxylic acid having 6 to 14 carbon atoms. The aliphatic diol and the aliphatic dicarboxylic acid can be linear. If the aliphatic diol and aliphatic dicarboxylic acid are linear, a crystalline polyester having high crystallinity can be obtained. In place of the aliphatic dicarboxylic acid, an aromatic dicarboxylic acid can be used. Examples of the aromatic dicarboxylic acid include terephthalic acid, isophthalic acid, 2,6-naphthalenedicarboxylic acid and 4,4'-biphenyl dicarboxylic acid. These aromatic dicarboxylic acids may be used alone or in combination of two or more. Of these aromatic dicarboxylic acids, terephthalic acid can be used since terephthalic acid is easily obtained in the market and easily forms a polymer having a low melting-point. Also, a dicarboxylic acid having a double bond can be used. Since the dicarboxylic acid having a double bond crosslinks the whole resin by use of the double bond and thus can suppress hot offset during fixation.

Examples of the crystalline alkyl resin include a resin obtained by polymerization of a vinyl monomer having a molecular structure containing a linear alkyl group. As the vinyl monomer having a molecular structure containing a linear alkyl group, an alkyl acrylate or an alkyl methacrylate having an alkyl group of 12 or more carbon atoms can be used. Examples of the vinyl monomer include lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate and behenyl methacrylate. These vinyl monomers may be used alone or in combination of two or more. The crystalline alkyl resin can be obtained by polymerization performed at a temperature of preferably 40° C. or more, more preferably 50° C. or more and 90° C. or less.

A resin A may contain an amorphous resin. The amorphous resin refers to a resin showing no distinctive maximum endothermic peak in differential scanning calorimetry. However, the glass-transition temperature (Tg) of the amorphous resin is preferably 50.0° C. or more and 130.0° C. or less and more preferably 55.0° C. or more and 110.0° C. or less. Examples of the amorphous resin include an amorphous polyester, an amorphous polyurethane, an amorphous polyvinyl and an amorphous polyurea. These amorphous resins may be modified with urethane, urea or epoxy. Of these amorphous resins, in view of maintaining elasticity, an amorphous polyester, an amorphous polyvinyl and an amorphous polyurethane can be used. These amorphous resins may be used alone or in combination of two or more.

As the amorphous polyester, the same amorphous polyester as that can be used as a monomer precursor (described later) can be used.

In the amorphous polyurethane, "polyurethane" refers to a reaction product between a dial and a compound having a diisocyanate group. If the diol and diisocyanate group are appropriately controlled, polyurethanes having various functions can be obtained. Examples of the diisocyanate include an aromatic diisocyanate having 6 or more and 20 or less carbon atoms (excluding the carbon atom in an NCO group; the same is applied hereinbelow), an aliphatic diisocyanate having 2 or more and 18 or less carbon atoms, an alicyclic diisocyanate having 4 or more and 15 or less carbon atoms, modified compounds of these diisocyanates (modified compounds having a urethane group, a carbodiimide group, an allophanate group, a urea group, a biuret group, a uretdione group, a uretonimine group, an isocyanurate group and an oxazolidone group; hereinafter referred to as "modified diisocyanates") and mixtures containing 2 or more of these.

Examples of the aromatic diisocyanate include m- and/or p-xylylene diisocyanate (XDI) and α,α,α',α'-tetramethylxylylene diisocyanate. Examples of the aliphatic diisocyanate include ethylene diisocyanate, tetramethylene diisocyanate, hexamethylene diisocyanate (HDI) and dodecamethylene diisocyanate. Examples of the alicyclic diisocyanate include isophorone diisocyanate (IPDI), dicyclohexylmethane-4,4'-diisocyanate, cyclohexylene diisocyanate and methylcyclohexylene diisocyanate. These diisocyanates may be used alone or in combination of two or more. Of these diisocyanates, an aromatic diisocyanate having 6 or more and 15 or less carbon atoms, an aliphatic diisocyanate having 4 or more and 12 or less carbon atoms and an alicyclic diisocyanate having 4 or more and 15 or less are preferable and, XDI, IPDI and HDI are more preferable. In addition to diisocyanate, a trifunctional or polyfunctional isocyanate compound can be used. As the diol, the same divalent alcohol as that can be used for producing an amorphous polyester (described later) can be used.

As a monomer that can be used for producing the amorphous polyvinyl, the same vinyl compound as that can be used for producing a monomer X (described later) can exemplified.

As the resin A, a block polymer obtained by chemically binding a crystalline resin component and an amorphous resin component can also be used. Examples of the block polymer include a CD-diblock polymer formed of a crystalline resin component (C) and an amorphous resin component (D), a CDC-triblock polymer, a DCD-triblock polymer and a CDCD-multiblock polymer. The block polymer shows a distinctive melting point (peak) in differential scanning calorimetry measurement using a differential scanning calorimeter (DSC), in the same manner as in other crystalline resins.

As a method of preparing the block polymer, the following methods can be exemplified: a two-step method in which a component formed of a crystalline resin component for forming a crystal portion and a component formed of an amorphous resin component for forming an amorphous portion are separately prepared and then combined, and a one-step method in which a component forming a crystal portion and a component forming an amorphous portion are simultaneously supplied to prepare the block polymer at a time. Each of the block polymers can be produced by a method selected from various methods in consideration of the reactivity of its terminal functional group.

In the case where the crystalline resin component and amorphous resin component both are polyester resins, the block polymer is prepared by separately preparing individual components and then binding the components, if necessary, use of a binding agent. In the particular case where one of the polyester resins has a high acid value and the other polyester resin has a high hydroxyl value, the polyester resins can be bound without using a binding agent. In this case, the reaction can be carried out at a temperature of about 200° C. Examples of the binding agent when used include a polycarboxylic acid, a polyhydric alcohol, a polyvalent isocyanate, a polyfunctional epoxy and a polyvalent acid anhydride.

In another case where the crystalline resin component is a polyester and the amorphous resin component is polyurethane, the block polymer can be prepared by separately preparing individual components and carrying out a urethane reaction between an alcohol-terminal of the polyester and an isocyanate-terminal of the polyurethane. Alternatively, the block polymer is synthesized by mixing a polyester having an alcohol-terminal and a diol and a diisocyanate constituting a polyurethane, followed by heating.

In the case where the crystalline resin component and the amorphous resin component both are a vinyl resin, the block polymer is prepared by polymerizing one of the components to obtain a vinyl polymer and then initiating polymerization of the other component from the end of the vinyl polymer.

The proportion of the crystalline resin component (that is, the part which can become a crystal structure) in the block polymer, is preferably 50.0 mass % or more and 90.0 mass % or less and more preferably 60.0 mass % or more and 85.0 mass % or less.

(Resin B)

The resin B is a polymer of a monomer composition containing a monomer X having polymerizable unsaturated groups at the both ends. The resin B can have a cross-linked structure by polymerizing the monomer composition containing a monomer X. This means that solvent resistance can be ensured. Note that, in the case where the monomer X has a branched structure and the number of ends is three or more, the two ends of the longest one of the molecular chains are regarded as the both ends of the monomer.

The peak molecular weight (Mp) of the monomer X is 5,000 or more and 50,000 or less. The molecular weight (Mp) of 5,000 or more and 50,000 or less of the monomer X means that the distance between crosslinking sites of a resin B is long. If the distance between crosslinking sites is long, the resin will not be rigid and can maintain flexibility even if crosslinks are present. As a result, affinity of the resin for the resin solution can be ensured. That is, if a monomer X having Mp within the aforementioned range is used, solvent resistance and interface localization can be both obtained. In contrast, if Mp of the monomer X is less than 5,000, the distance between crosslinking sites becomes short, with the result that sufficient flexibility of the resin B is not obtained and a degree of interface localization reduces. Accordingly, the particle size distribution of a toner particle is broadened. In contrast, if Mp of the monomer X exceeds 50,000, when the monomer composition is polymerized, an unreacted end that cannot be participated in polymerization tends to be generated. As a result, the resin B fails to contain a sufficient number of cross-linked structures and thus solvent resistance decreases. Consequently, an effective amount of dispersant reduces, coarse particles are produced. Mp of the monomer X is preferably 10,000 or more and 40,000 or less, more preferably and 12,000 or more and 30,000 or less and further preferably 15,000 or more and 20,000 or less. Note that, Mp of the monomer X is a value obtained by measurement according to the method described later.

The content of the monomer X based on the total amount of monomers of the monomer composition is 0.10% by mol or more and 3.00% by mol or less. If the content of the monomer X falls within the range, an appropriate number of cross-linked structures can be introduced into the resin B and solvent resistance can be ensured. If the content is less than 0.10% by mol, the number of cross-linked structures of the resin B is insufficient, and solvent resistance decreases. Consequently, an effective amount of dispersant becomes insufficient and a large number of coarse particles are produced. In contrast, if the content of the dispersant exceeds 3.00% by mol, the number of cross-linked structures in the resin B becomes excessively large, with the result that the affinity for the resin solution decreases and a degree of interface localization reduces. Accordingly, the particle size distribution is broadened. The content is preferably 0.30% by mol or more and 2.00% by mol or less, more preferably 0.50% by mol or more and 2.00% by mol or less and further preferably 0.60% by mol or more and 1.00% by mol or less.

The monomer X can be obtained, for example, by coupling a terminal functional group of a monomer precursor with a vinyl compound to introduce a polymerizable unsaturated group into the both ends. In the coupling, a vinyl compound containing a functional group, which is capable of reacting with a terminal functional group of a monomer precursor as mentioned above, may be directly coupled. Alternatively, both ends of a monomer precursor may be modified with a binding agent to convert the ends so as to be reactive with a functional group contained in a vinyl compound, and then subjected to a coupling reaction. More specifically, the following methods can be exemplified.

(1) Method of subjecting a monomer precursor having a carboxy group at the both ends and a vinyl compound having a hydroxy group to a condensation reaction.

(2) Method of subjecting a monomer precursor having a hydroxy group at the both ends and a vinyl compound having an isocyanate group to a urethanization reaction.

(3) Method of subjecting a monomer precursor having a hydroxy group at the both ends and a vinyl compound having a hydroxy group to a urethanization reaction by use of a diisocyanate serving as a binding agent.

(4) Method of subjecting a monomer precursor having a hydroxy group at both ends and a vinyl compound having a carboxyl halide to an esterification reaction.

Examples of the vinyl compound having a hydroxy group include hydroxystyrene, N-methylol acrylamide, N-methylol methacrylamide, hydroxyethyl acrylate, hydroxyethyl methacrylate, hydroxypropyl acrylate, hydroxypropyl methacrylate, polyethylene glycol monoacrylate, polyethylene glycol monomethacrylate, allyl alcohol, methallyl alcohol, crotyl alcohol, isocrotyl alcohol, 1-buten-3-ol, 2-buten-1-ol, 2-butene-1,4-diol, propargyl alcohol, 2-hydroxyethyl propenyl ether and sucrose allyl ether. These vinyl compounds may be used alone or in combination of two or more. Of these vinyl compounds, hydroxyethyl acrylate and hydroxyethyl methacrylate can be used.

Examples of the vinyl compound having an isocyanate group include 2-isocyanatoethyl acrylate, 2-isocyanatoethyl methacrylate, 2-(0-[1'-methylpropylideneamino]carboxyamino)ethyl methacrylate, 2-[(3,5-dimethylpyrazolyl) carbonylamino]ethyl methacrylate and m-isopropenyl-α,α-dimethylbenzyl isocyanate. These vinyl compounds may be used alone or in combination of two or more. Of these vinyl compounds, 2-isocyanatoethyl acrylate and 2-isocyanatoethyl methacrylate can be used.

Examples of the diisocyanate include an aliphatic diisocyanate having 2 or more and 18 or less carbon atoms (excluding a carbon atom in an NCO group, the same is applied hereinbelow), an alicyclic diisocyanate having 4 or more and 15 or less carbon atoms, an aromatic diisocyanate having or more and 20 or less carbon atoms and modified compounds of these diisocyanates (modified compounds having a urethane group, a carbodiimide group, an allophanate group, a urea group, a biuret group, a uretdione group, a uretoimine group, an isocyanurate group and an oxazolidone group; hereinafter also referred to as "modified diisocyanates"). These diisocyanate compounds may be used alone or in combination of two or more.

Examples of the aliphatic diisocyanate include ethylene diisocyanate, tetramethylene diisocyanate, hexamethylene diisocyanate (HDI) and dodecamethylene diisocyanate. Examples of the alicyclic diisocyanate include isophorone diisocyanate (IPDI), dicyclohexylmethane-4,4'-diisocyanate, cyclohexylene diisocyanate and methyl cyclohexylene diisocyanate. Examples of the aromatic diisocyanate include m- and/or p-xylylene diisocyanate (XDI) and α,α,α',α'-tetramethylxylylene diisocyanate. These diisocyanates may be used alone or in combination of two or more. Of these diisocyanates, XDI, HDI and IPDI can be used.

Examples of the vinyl compound having a carboxylic halide include acryloyl chloride, methacryloyl chloride, acryloyl bromide and methacryloyl bromide. These vinyl compounds may be used alone or in combination of two or more.

The monomer X can contain a polyester structure. If the monomer X contains a polyester structure, the affinity for the resin solution is easily ensured. If monomer X contains a polyester structure, a polyester can be used as the monomer precursor. As the polyester, a crystalline polyester and an amorphous polyester are exemplified. The crystalline polyester can be a crystalline polyester using an aliphatic diol having 2 or more and 20 or less carbon atoms and an aliphatic dicarboxylic acid having 2 or more and 20 or less carbon atoms, as a starting material. The aliphatic diol and the aliphatic dicarboxylic acid can be linear.

Examples of the linear aliphatic diol (aliphatic diol having a linear structure) include ethylene glycol, 1,3-propanediol, 1,4-butandiol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. These diols may be used alone or in combination of two or more.

Examples of the linear aliphatic dicarboxylic acid (aliphatic dicarboxylic acid having a linear structure) include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid. These linear aliphatic dicarboxylic acids may be used alone or in combination of two or more.

A method of producing the crystalline polyester is not particularly limited. The crystalline polyester can be produced by a conventional polyester polymerization method of reacting a diol monomer with a dicarboxylic acid monomer. For example, a direct polycondensation and a transesterification are selectively used depending upon the types of monomers.

The crystalline polyester can be produced by a polymerization reaction at a temperature of 180° C. or more and 230° C. or less. The polymerization reaction can be carried out in a reduced system as necessary while removing water and alcohol produced during condensation. If a monomer(s) are insoluble or incompatible at a reaction temperature, a solvent having a high boiling point can be added as a solubilizing agent to dissolve the monomer(s). The polycondensation reaction can be carried out while removing the solubilizing agent. If a less-compatible monomer is present in the polycondensation reaction, the less-compatible monomer and the acid or alcohol, which is to be subjected to polycondensation with the monomer, can be previously condensed and then subjected to polycondensation with a main component.

Examples of the catalyst that can be used for producing the crystalline polyester include a titanium catalyst such as titanium tetra-ethoxide, titanium tetra-propoxide, titanium tetra-isopropoxide and titanium tetra-butoxide and a tin catalyst such as dibutyltin dichloride, dibutyltin oxide and diphenyltin oxide. These catalysts may be used alone or in combination of two or more.

The melting point of the crystalline polyester is preferably 45.0° C. or more and 120.0° C. or less. In view of melting at the fixing temperature, the melting point of the crystalline polyester is more preferably 50.0° C. or more and 100.0° C. or less.

Examples of the monomer that can be used for producing the amorphous polyester include a di- or higher valent carboxylic acid and a divalent alcohol. Examples of a divalent carboxylic acid include a dibasic acid such as succinic acid, adipic acid, sebacic acid, phthalic acid, isophthalic acid, terephthalic acid, malonic acid and dodecenylsuccinic acid; and an aliphatic unsaturated dicarboxylic acid such as maleic acid, fumaric acid, itaconic acid and citraconic acid. Examples of a tri- or higher valent carboxylic acid include 1,2,4-benzenetricarboxylic acid and 1,2,5-benzenetricarboxylic acid. These divalent carboxylic acids may be used alone or in combination of two or more.

Examples of the divalent alcohol include an alkylene glycol such as ethylene glycol, 1,2-propylene glycol and 1,3-propylene glycol; an alkylene ether glycol such as polyethylene glycol and polypropylene glycol; an alicyclic diol such as 1,4-cyclohexane dimethanol; a bisphenol such as bisphenol A; and an alkylene oxide adduct, such as an ethylene oxide and propylene oxide, of an alicyclic dial. These divalent alcohols may be used alone or in combination of two or more. The alkyl moiety of an alkylene glycol and an alkylene ether glycol may be linear or branched. In the present invention, a branched alkylene glycol can be also used.

Although a method for synthesizing the amorphous polyester is not particularly limited and, for example, a transesterification and a direct polycondensation can be used alone or in combination of two or more.

In the case where a polyester as mentioned above (although the polyester mentioned above has a hydroxy group or a carboxy group at both ends) is used as a monomer precursor, a polyester having a hydroxy group at the both ends is preferably used. In preparing such a polyester, the molar ratio between an alcohol component and a carboxylic component (alcohol component/carboxylic component) is preferably 1.02 or more and 1.20 or less.

The resin B may be a polymer of a monomer composition containing, in addition to the monomer X, a monomer Y having a polymerizable unsaturated group at one of the ends. Since the monomer Y is bound via only one end in the resin B, mobility of the molecule is high and the affinity for the resin solution can be improved, with the result that a degree of interface localization can be improved. Accordingly, particle size distribution can be further narrowed.

Mp of the monomer Y is preferably 300 or more and 30,000 or less, more preferably 500 or more and 10,000 or less and further preferably 1,000 or more and 8,000 or less. If Mp of the monomer Y is 300 or more, mobility of the molecule is easily ensured and a degree of interface localization is likely to be further improved. If Mp of the monomer Y is 30,000 or less, it becomes easy to introduce the monomer Y during polymerization. Note that, Mp of the monomer Y is a value obtained by measurement according to the method described later.

The content of the monomer Y is 5.0 mass % or more and 30.0 mass % or less based on the total amount of monomers of the monomer composition. If the content of the monomer Y falls within the range, a component derived from a monomer Y is contained in a resin B, with the result that the affinity for the resin solution is improved. The content of the monomer Y is more preferably 7.0 mass % or more and 25.0 mass % or less and further preferably 10.0 mass % or more and 20.0 mass % or less. Note that, if the content of the monomer Y exceeds 30.0 mass %, the resin B tends to soften and the solvent resistance thereof decreases in some cases.

The monomer Y can contain a polyester structure. Since the monomer Y contains a polyester structure, the affinity for the resin solution tends to be improved. The monomer Y can be obtained in the same manner as in the synthesis method of the monomer X except that the monomer precursor having a functional group at both ends is replaced with a monomer precursor having a functional group at one of the ends.

The resin B can be a polymer obtained by polymerization of a monomer composition containing an organopolysiloxane compound having an organopolysiloxane structure represented by the following formula (i) in addition to the monomer X and the monomer Y.

(i)

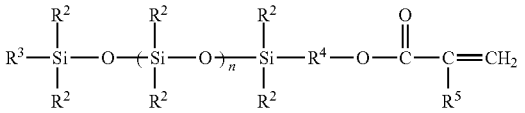

The organopolysiloxane structure refers to a structure having a repeat unit of a Si—O bond and further two alkyl groups bound to the Si. Since the organopolysiloxane structure has a low surface tension, even if a fixed image is stored in a high-temperature environment, a reduction in fixing power of the fixed image can be suppressed. In Formula (i), $R^2$ and $R^3$ each represent an alkyl group; $R^4$ represents an alkylene group; and $R^5$ represents a hydrogen atom or a methyl group. The number of carbon atoms of each of the alkyl groups represented by $R^2$ and $R^3$ is preferably 1 or more and 3 or less and more preferably 1. The number of carbon atoms of the alkylene group represented by $R^4$ is preferably 1 or more and 5 or less. Reference symbol n, which represents a degree of polymerization, is 2 or more. The degree of polymerization n, is preferably 2 or more and 150 or less and more preferably 2 or more and 50 or less.

The resin B can be a polymer obtained by polymerization of a monomer composition containing other vinyl monomers in addition to the monomer X, the monomer Y and an organopolysiloxane compound. Examples of the vinyl monomers include an aliphatic vinyl hydrocarbon, an alicyclic vinyl hydrocarbon, an aromatic vinyl hydrocarbon, a carboxyl group-containing vinyl monomer and a metal salt thereof and a vinyl ester. These vinyl monomers may be used alone or in combination of two or more.

Examples of the aliphatic vinyl hydrocarbon include an alkene such as ethylene, propylene, butene, isobutylene, pentene, heptene, di-isobutylene, octene, dodecene, octadecene, α-olefin except the aforementioned ones; and an alkadiene such as butadiene, isoprene, 1,4-pentadiene, 1,6-hexadiene and 1,7-octadiene. These aliphatic vinyl hydrocarbons may be used alone or in combination of two or more.

Examples of the alicyclic vinyl hydrocarbon include a mono- or di-cycloalkene and an alkadiene such as cyclohexene, cyclopentadiene, vinyl cyclohexene and ethylidenebicycloheptene; and a terpene such as pinene, limonene and indene. These alicyclic vinyl hydrocarbons may be used alone or in combination of two or more.

Examples of the aromatic vinyl hydrocarbon include a styrene such as α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene and trivinylbenzene and their styrenes having a substituent of hydrocarbyl (alkyl, cycloalkyl, aralkyl and/or alkenyl); and vinylnaphthalene. These aromatic vinyl hydrocarbons may be used alone or in combination of two or more.

Examples of the carboxyl group-containing vinyl monomer and a metal salt thereof include an unsaturated monocarboxylic acid having 3 or more and 30 or less carbon atoms such as acrylic acid, methacrylic acid, maleic acid, maleic anhydride, a monoalkyl maleate, fumaric acid, a monoalkyl fumarate, crotonic acid, itaconic acid, monoalkyl itaconate, itaconic acid glycol monoether, citraconic acid, mono-alkyl citraconate and a carboxyl group-containing vinyl monomer of cinnamic acid; and an unsaturated dicarboxylic acid, an anhydride thereof and a monoalkyl (having 1 or more and 27 or less carbon atoms) ester thereof; and metal salts thereof. The carboxyl group-containing vinyl monomers and metal salts thereof may be used alone or in combination of two or more.

Examples of the vinyl esters include an alkyl acrylate and an alkyl methacrylate having a linear or branched alkyl group of 1 or more and 11 or less carbon atoms, such as vinyl acetate, vinyl butyrate, vinyl propionate, vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxyacetate, vinyl benzoate, ethyl α-ethoxyacrylate; methyl acrylate, methyl methacrylate, ethyl acrylate, ethyl methacrylate, propyl acrylate, propyl methacrylate, butyl acrylate, butyl methacrylate, 2-ethylhexyl acrylate and 2-ethylhexyl methacrylate; a dialkyl fumarate (a dialkyl ester of fumaric acid) having two alkyl groups, which are linear, branched or alicyclic groups of 2 or more and 8 or less carbon atoms; a dialkyl maleate (a dialkyl ester of maleic acid) having two alkyl groups, which are linear, branched or alicyclic groups of 2 or more and 8 or less carbon atoms; a polyallyloxy alkane such as diallyloxy ethane, triallyloxy ethane, tetra-allyloxy ethane, tetra-allyloxy propane, tetra-allyloxy butane and tetra-methallyloxy ethane; a vinyl monomer having a polyalkylene glycol chain, such as polyethylene glycol (molecular weight: 300) monoacrylate, polyethylene glycol (molecular weight: 300) monomethacrylate, polypropylene glycol (molecular weight: 500) monoacrylate, polypropylene glycol (molecular weight: 500) monomethacrylate, methyl alcohol ethylene oxide (hereinafter ethylene oxide is simply referred to as EO) 10-mole adduct acrylate, methyl alcohol EO 10-mole adduct methacrylate, lauryl alcohol EO-30 mole adduct acrylate and lauryl alcohol EO-30 mole adduct methacrylate; and a polyacrylate and a polymethacrylate such as a polyacrylate and a polymethacrylate of a polyhydric alcohol. These vinyl esters may be used alone or in combination of two or more.

Of these vinyl esters, styrene and methacrylic acid can be used as other vinyl monomers.

The toner particle according to the present invention preferably contains the resin B in an amount of 3.0 mass % or more and 15.0 mass % or less based on the resin A.

(Wax)

Toner produced by the method according to the present invention preferably further contains a wax in order to ensure releasability. Examples of the wax include, but not particularly limited to, an aliphatic hydrocarbon-based wax such as low molecular weight polyethylene, low molecular weight polypropylene, low molecular weight olefin copolymer, microcrystalline wax, paraffin wax and Fischer-Tropsch wax; an oxide of an aliphatic hydrocarbon-based wax such as oxidized polyethylene wax; an ester wax containing a fatty acid ester as a main component, such as an aliphatic hydrocarbon-based ester wax; a partly or wholly deoxidized fatty acid ester, such as deoxidized carnauba wax; a partial esterified fatty acid with a polyhydric alcohol such as behenic acid monoglyceride; and a methyl ester compound having a hydroxyl group obtained by hydrogenating a vegetal oil. These waxes may be used alone or in combination of two or more. Of these waxes, an aliphatic hydrocarbon-based wax and an ester wax can be used. As the ester wax, a trifunctional or polyfunctional ester wax can be used.

The a trifunctional or polyfunctional ester wax can be obtained, for example, by condensation between a tri- or higher valent acid and a long-chain linear saturated alcohol or esterification between a tri- or higher valent alcohol and a long-chain linear saturated fatty acid.

Examples of the tri- or higher valent acid include trimellitic acid and butane tetracarboxylic acid. These tri- or higher valent acids may be used alone or in combination of two or more.

A long-chain linear saturated alcohol as mentioned above is represented by $C_nH_{2n+1}OH$ where n can represent 5 or more and 28 or less. Examples of the long-chain linear saturated alcohol include caprylic alcohol, lauryl alcohol, myristyl alcohol, palmityl alcohol, stearyl alcohol and behenyl alcohol. These alcohols may be used alone or in combination of two or more. Of these alcohols, myristyl alcohol, palmityl alcohol, stearyl alcohol and behenyl alcohol can be used in view of the melting point of a wax.

Examples of the tri- or higher valent alcohol include glycerin, trimethylolpropane, erythritol, pentaerythritol, sorbitol, diglycerin, triglycerin, tetraglycerin, hexaglycerin, decaglycerin, ditrimethylolpropane, tris-trimethylolpropane, dipentaerythritol and tris-pentaerythritol. These alcohols may be used alone or in combination of two or more. Of these alcohols, a compound having a branched structure is preferable, pentaerythritol or dipentaerythritol is more preferable and dipentaerythritol is further preferable.

A long-chain, linear saturated fatty acid as mentioned above is represented by $C_nH_{2n+1}COOH$ where n can be 5 or more and 28 or less. Examples of the long-chain, linear saturated fatty acid include caproic acid, caprylic acid, octyl acid, nonyl acid, decanoic acid, dodecanoic acid, lauric acid, tridecanoic acid, myristic acid, palmitic acid, stearic acid and behenic acid. These fatty acids may be used alone or in combination of two or more. Of these fatty acids, myristic acid, palmitic acid, stearic acid and behenic acid can be used in view of the melting point of a wax.

The content of wax in a toner particle as mentioned above is preferably 1.0 mass % or more and 20.0 mass % or less and more preferably 2.0 mass % or more and 15.0 mass %.

The wax has a maximum endothermic peak in measurement by a differential scanning calorimeter (DSC) in a range of preferably 60° C. or more and 120° C. or less and more preferably 60° C. or more and 90° C. or less.

(Colorant)

The toner to be produced by the method according to the present invention may contain a colorant. Examples of the colorant include an organic pigment, an organic dye, an inorganic pigment, a black colorant such as carbon black and a magnetic particle. Other than these, a colorant known in the art and usually used in toner can be used. The colorant is appropriately selected in view of hue angle, chroma, brightness, light resistance, OHP transparency and dispersibility in toner.

Examples of a colorant for yellow include a condensed azo compound, an isoindolinone compound, an anthraquinone compound, an azo metal complex, a methine compound and an allylamide compound. More specifically, C. I. Pigment Yellow 12, 13, 14, 15, 17, 62, 74, 83, 93, 94, 95, 109, 110, 111, 128, 129, 147, 155, 168 and 180 can be used. These yellow colorants may be used alone or in combination of two or more.

Examples of a colorant for magenta include a condensed azo compound, a diketopyrrolopyrrole compound, anthraquinone compound, a quinacridone compound, a basic dye lake compound, a naphthol compound, a benzimidazolone compound, a thioindigo compound and a perylene compound. More specifically, C. I. Pigment Red 2, 3, 5, 6, 7, 23, 48:2, 48:3, 48:4, 57:1, 81:1, 122, 144, 146, 166, 169, 177, 184, 185, 202, 206, 220, 221 and 254 can be used. These colorants for magenta may be used alone or in combination of two or more.

Examples of a colorant for cyan include a copper phthalocyanine compound and a derivative thereof, an anthraquinone compound and a basic dye lake compound. More specifically, C. I. Pigment Blue 1, 7, 15, 15:1, 15:2, 15:3, 15:4, 60, 62 and 66 can be used. These colorants for cyan may be used alone or in combination of two or more.

The colorant is preferably added in an amount of 1.0 part by mass or more and 20.0 parts by mass or less based on 100.0 parts by mass of a resin A. In contrast, in the case where a magnetic particle is used as a colorant, the addition amount of colorant is preferably 40.0 parts by mass or more and 150.0 parts by mass or less based on 100.0 parts by mass of the resin A.

(Charge Control Agent)

The toner to be produced by the method according to the present invention may contain a charge control agent on an as-needed basis. If a charge control agent is added, charge characteristics can be stabilized and controlled to have an optimum triboelectric charge depending upon the developing system.

Examples of the charge control agent for controlling a toner to be negatively charged include an organometallic compound and a chelate compound. Specific examples thereof include a monoazo metal compound, an acetylacetone metal compound and metal compounds based on an aromatic oxycarboxylic acid, an aromatic dicarboxylic acid, an oxycarboxylic acid and a dicarboxylic acid. Examples of the charge control agent for controlling a toner to be positively charged include nigrosine, a quaternary ammonium salt, a metal salt of a higher fatty acid, a diorganotin borate, a guanidine compound and an imidazole compound. These charge control agents may be used alone or in combination of two or more.

The content of the charge control agent is preferably 0.01 mass % or more and 20.0 mass % or less based on the toner particle and more preferably 0.5 mass % or more and 10.0 mass % or less.

(Inorganic Particle)

The toner to be produced by the method according to the present invention can contain an inorganic particle as a flowability improver. Examples of the inorganic particle include a silica particle, a titanium oxide particle, an alumina particle or a complex oxide particle thereof. Of these inorganic particles, a silica particle and a titanium oxide particle can be used.

Examples of the silica particle include a dry silica particle or a fumed silica particle, which is produced by vapor-phase oxidation of a silicon halide, and a wet silica particle produced from water glass. Of these silica particles, dry silica particle, in which number of silanol groups present on the surface and the interior of a silica particle is low and the content of $Na_2O$ and $SO_3^{2-}$ is low, can be used. The dry silica particle may be a composite particle of silica and an oxide of another metal which is produced by using a metal halide compound such as aluminum chloride and titanium chloride, with a silicon halide compound.

The inorganic particle can be added externally to a toner particle in view of flowability improvement and uniform electrification of toner. Further to control the charge amount of toner, improve the environmental stability and improve properties in high humidity environment, a hydrophobically treated inorganic particle can be used. If the inorganic particle added to a toner adsorbs moisture, the charge amount of toner decreases, with the result that developing property and transfer property of the toner decrease in some cases.

Examples of an agent used for hydrophobizing an inorganic particle as mentioned above include an unmodified or various-modified silicone varnish, an unmodified or various-modified silicone oil, a silane compound, a silane coupling agent, other organic silicon compound and an organic titanium compound. These hydrophobizing agents may be used alone or in combination of two or more. Of these agents, an inorganic particle treated with a silicone oil can be used. In particular, a hydrophobic inorganic particle treated with a silicone oil can be used, which is obtained by treating an inorganic particle with a coupling agent (to be hydrophobic) simultaneously or later, with a silicone oil.

The addition amount of the inorganic particle is preferably 0.1 part by mass or more and 4.0 parts by mass or less and more preferably 0.2 parts by mass or more and 3.5 parts by mass or less based on 100.0 parts by mass of the toner particle.

(Step a), b) and c))

First, in Step a), the resin A and an organic solvent are mixed to prepare a resin solution. As the organic solvent, an organic solvent capable of dissolving a resin A can be used. Examples of the organic solvent include acetone, methyl ethyl ketone, tetrahydrofuran and ethyl acetate. These organic solvents may be used alone or in combination of two or more. When the resin A is added to an organic solvent as mentioned above, if necessary, a colorant, a wax and other additives as mentioned above may be added.

Next, in Step b), the resin solution, a resin fine particle containing the resin B and a dispersion medium are mixed to form a droplet of the resin solution whose surface has been covered with the resin fine particle. In the method according to the present invention, the dispersion medium used in Step b) is preferably a non-aqueous medium and more preferably a medium containing carbon dioxide. Now, a method of producing a toner by using a dispersion medium containing carbon dioxide will be described; however, the method according to the present invention is not limited to the following method.

In the case where a dispersion medium containing carbon dioxide is used, in Step b), for example, a resin solution as mentioned above, a resin fine particle containing the resin B and high-pressure carbon dioxide are mixed to form a droplet of the resin solution whose surface has been covered with the resin fine particle. The high-pressure carbon dioxide herein can be carbon dioxide having a pressure of 1.5 MPa or more. Alternatively, liquid state or supercritical state carbon dioxide may be used singly as a dispersion medium or another component such as an organic solvent may be contained in the dispersion medium. In this case, high-pressure carbon dioxide and the organic solvent can form a homogeneous phase.

In the high-pressure carbon dioxide serving as a dispersion medium, a resin fine particle containing a resin B serves as a dispersant; however, further a liquid-state dispersion stabilizer may be added. Examples of the dispersion stabilizer include a compound containing an organopolysiloxane structure as mentioned above and fluorine having high affinity for carbon dioxide and a surfactant such as a nonionic surfactant, an anionic surfactant and a cationic surfactant. These dispersion stabilizers may be used alone or in combination of two or more.

As a method of dispersing a dispersant as mentioned above into a dispersion medium containing high-pressure carbon dioxide, any method may be employed. As an example, a method of charging a container with a dispersant as mentioned above and a dispersion medium containing high-pressure carbon dioxide, and directly dispersing the dispersant and the dispersion medium by agitation or ultrasonic irradiation, is exemplified. As another example, a method of charging a container with a dispersion medium containing high-pressure carbon dioxide, and introducing a dispersion liquid having the dispersant as mentioned above dispersed in an organic solvent into the container by use of a high-pressure pump, is exemplified.

As a method of dispersing a resin solution as mentioned above into a dispersion medium containing high-pressure carbon dioxide, any method may be employed. As an example, a method of introducing the resin solution in a container containing a dispersion medium containing high-pressure carbon dioxide in which the dispersant is dispersed, by use of a high-pressure pump. is exemplified. Alternatively, a dispersion medium containing high-pressure carbon dioxide in which the dispersant is dispersed may be introduced in a container charged with the resin solution.

The dispersion medium containing high-pressure carbon dioxide can be a single phase. In the case where granulation is made by dispersing the resin solution in high-pressure carbon dioxide, the organic solvent in a droplet partly moves into a dispersion medium. At this time, if carbon dioxide and the organic solvent form separate phases, the stability of a droplet is deteriorated in some cases. Accordingly, the temperature and pressure of the dispersion medium and the amount of resin solution relative to high-pressure carbon dioxide can be controlled to fall within the range where carbon dioxide and the organic solvent can form a homogeneous phase.

When the temperature and pressure of the dispersion medium are selected, not only granulation (formability of a droplet) but also solubility of constitutional components of the resin solution to the dispersion medium can be considered. For example, the resin A in the resin solution is dissolved in the dispersion medium depending upon the temperature and pressure conditions, in some cases. Usually, the lower the temperature and pressure, the lower the solubility of the components to a dispersion medium; however, the formed droplets easily aggregate and combine, with the result that granulation property decreases. In contrast, as the temperature and pressure increase, granulation property is improved; however, the components are easily dissolved in the dispersion medium. Accordingly, in Step b), the temperature of the dispersion medium can be 10° C. or more and 50° C. or less.

The pressure in the container is preferably 1.5 MPa or more and 20.0 MPa or less and more preferably 2.0 MPa or more and 15.0 MPa or less. Note that, regarding the pressure, if a component other than carbon dioxide is contained in a dispersion medium, the total pressure of carbon dioxide and the component is referred to.

Next, in Step c), the organic solvent in a droplet is removed. In the case where high-pressure carbon dioxide is used as the dispersion medium, the organic solvent remaining in the droplet can be removed via the dispersion medium containing high-pressure carbon dioxide. More specifically, the organic solvent can be removed by further adding high-pressure carbon dioxide to the dispersion medium having a droplet dispersed therein to extract the remaining organic solvent into a carbon dioxide phase, and replacing the carbon dioxide containing the organic solvent further with high-pressure carbon dioxide.

The dispersion medium having a droplet dispersed therein may be mixed with high-pressure carbon dioxide, for example, by adding carbon dioxide having a higher pressure than the dispersion medium to the dispersion medium having a droplet dispersed therein, or alternatively by adding the dispersion medium having a droplet dispersed therein to carbon dioxide having a lower pressure than the dispersion medium. As a method of replacing the carbon dioxide containing an organic solvent with higher pressure carbon dioxide, a method of supplying the high-pressure carbon dioxide while the pressure in the container is maintained to be constant. The toner particle to be formed at this time can be trapped by a filter.

If replacement with the high-pressure carbon dioxide is insufficient and an organic solvent remains in the dispersion medium, the organic solvent dissolved in the dispersion medium is condensed and a toner particle dissolves again when the pressure in the container is reduced in order to collect the toner particles obtained, in some cases; in other cases, toner particles are mutually combined. Because of this, replacement with the high-pressure carbon dioxide can be performed until an organic solvent is completely removed. The volume of high-pressure carbon dioxide to be supplied is preferably 1 or more and 100 fold or less relative to the volume of the dispersion medium, more preferably, 1 or more and 50 fold or less and further preferably, 1 or more and 30 fold or less.

In taking out a toner particle from a dispersion having a toner particle dispersed therein and containing high-pressure carbon dioxide by reducing the pressure in the container, the pressure may be reduced up to the atmospheric pressure at room temperature at one stroke, or alternatively, reduced stepwise by sequentially arranging several containers whose pressure values are independently controlled. The pressure reduction rate can be set within the range where a toner particle is not foamed. Note that, in the method according to the present invention, the organic solvent and carbon dioxide to be used can be recycled.

[Method of Producing Resin Particle]

The method of producing a resin particle according to the present invention has the following steps a), b) and c).

a) preparing a resin solution by mixing a resin A and an organic solvent b) mixing the resin solution, a resin fine particle containing a resin B, and a dispersion medium to form a droplet of the resin solution whose surface has been covered with the resin fine particle, and c) removing the organic solvent in the droplet.

The resin B is a polymer obtained by polymerizing a monomer composition containing a monomer X having a polymerizable unsaturated group at both ends. The monomer X has a peak molecular weight (Mp) of 5,000 or more and 50,000 or less. The content of the monomer X is 0.10% by mol or more and 3.00% by mol or less based on the total amount of monomers of the monomer composition. The resin A and the monomer X satisfy the following formula (1), $$|SP_X - SP_A| \leq 2.0 \quad (1)$$

where $SP_A$ represents a solubility parameter of the resin A, and $SP_X$ represents a solubility parameter of the monomer X. The method of producing a resin particle according to the present invention can be carried out in the same manner as in the method (described above) for producing a toner particle.

[Methods for Measuring Physical Properties]

(Method of Measuring Number Average Molecular Weight Mn, Weight Average Molecular Weight Mw and Peak Molecular Weight Mp)

The molecular weights (Mn, Mw and Mp) of a toner according to the present invention and materials for the toner are obtained by gel permeation chromatography (GPC) as follows. First, a sample is dissolved in tetrahydrofuran (THF) at room temperature for 24 hours. The resultant solution is filtered with a solvent resistant membrane filter "Myshori disc" (trade name, manufactured by Tosoh Corporation) having a pore diameter of 0.2 μm to obtain a sample solution. The sample solution is controlled such that the concentration of THF-soluble components is about 0.8 mass %. Molecular weights are measured by using the sample solution in the following conditions.

Apparatus: HLC8120 GPC (detector: RI) (trade name, manufactured by Tosoh Corporation)

Column: 7-series column of Shodex KF-801, 802, 803, 804, 805, 806, 807 (trade name, manufactured by SHOWA DENKO K.K.)

Eluent: Tetrahydrofuran (THF)

Flow rate: 1.0 ml/min

Oven temperature: 40.0° C.

Sample injection volume: 0.10 ml

In computationally obtaining each of the molecular weights of the sample, a molecular weight calibration curve is used, which is obtained by using a standard polystyrene resin (for example, trade name: TSK standard polystyrene F-850, F-450, F-288, F-128, F-80, F-40, F-20, F-10, F-4, F-2, F-1, A-5000, A-2500, A-1000, A-500, manufactured by Tosoh Corporation).

(Method of Obtaining the Particle Size of Resin Fine Particle, Wax Particle and Colorant Particle)

The particle size of each of the particles is obtained as a volume average particle diameter (μm or nm) by measuring sizes by use of a microtrack particle size distribution measurement apparatus HRA (X-100) (trade name, manufactured by MicrotracBEL Corp. (Old name: NIKKISO CO. LTD.)) in a range of 0.001 μm to 10 μm. Note that water is used as a diluting solvent.

(Method of Measuring Weight Average Particle Diameter (D4), Number Average Particle Diameter (D1), Particle Size Distribution of the Toner Particle and Amount of Coarse Particles)

The weight average particle diameter (D4) and number average particle diameter (D1) of a toner particle are computationally obtained as follows. As a measurement apparatus, a precise particle size distribution measurement apparatus, "COULTER counter, Multisizer 3" (trade name, manufactured by BECKMAN COULTER) equipped with a 100 μm-aperture tube and based on a micropore electrical resistance method, is used. For setting measurement conditions and analysis for measurement data, the accompanying dedicated software, "BECKMAN COULTER Multisizer 3, Version 3.51" (trade name, manufactured by BECKMAN COULTER) is used. Note that, 25,000 effective measurement channels are used for measurement.

The aqueous electrolyte solution to be used in measurement is prepared by dissolving sodium chloride (special grade) in ion-exchange water so as to obtain a concentration of about 1 mass %. For example, "ISOTON II" (trade name, manufactured by BECKMAN COULTER) can be used.

Note that, before measurement and analysis, the dedicated software is configured as follows. In the screen "Change standard measurement method (SOM)" of the dedicated software, the total count number of particles in control mode is set at 50,000; number of measurement times is set at 1; and as Kd value, a value obtained by using "standard particle of 10.0 μm" (manufactured by BECKMAN COULTER) is set up. Then, "threshold/noise level" button is pressed. In this manner, the threshold and noise level is automatically set. Furthermore, "current" is set at 1600 μA; "gain" at 2; "electrolytic solution" at ISOTON II; and then "Flush aperture tube after measurement" is checked. In the setup screen "Change pulse to particle size" of the dedicated software, "bin interval" is set at logarithmic particle size; "particle size bin" at 256 particle size bin; and "range of particle size" at 2 μm to 60 μm. More specifically, the measurement is as follows.

(1) A 250 ml-glass beaker (exclusively for Multisizer 3) having a circle bottom is charged with an aqueous electrolyte solution (about 200 ml) as prepared above. The beaker is set up on a sample stand and a stirrer rod is allowed to rotate counterclockwise at a rate of 24 rotations/second. Dirt and bubbles in an aperture tube are removed by the function of "Flush aperture" of the dedicated software in advance.

(2) A 100 ml-class beaker having a flat bottom is charged with about 30 ml of the aqueous electrolyte solution. To this, about 0.3 ml of a diluted solution, in which "Contaminon N" (trade name, an 10 mass % aqueous solution of a neutral detergent for precision measuring equipment, consisting of a non-ionic surfactant, an anionic surfactant and an organic builder, pH7; manufactured by Wako Pure Chemical industries Ltd.) is diluted about three fold by mass with ion exchange water, is added as a dispersant.

(3) An ultrasonic disperser, "Ultrasonic Dispension System Tetora 150" (trade name, manufactured by Nikkaki Bios Co., Ltd) with electric output value of 120 W is provided by installing two oscillators with oscillating frequency of 50 kHz mutually having 180-degree phase shift. In the water vessel in the ultrasonic disperser, about 3.3 L of ion-exchange water is poured and then, about 2 mL of Contaminon N is added.

(4) The beaker used in (2) is set up in a beaker-fitting hole of the ultrasonic disperser. The ultrasonic disperser is actuated and the installation height of the beaker is controlled such that the liquid-surface level of an aqueous electrolyte solution in the beaker is placed in a maximum resonant condition.

(5) While the aqueous electrolyte solution in the beaker (4) is irradiated with ultrasonic wave, about 10 mg of toner particle is added little by little to the aqueous electrolyte solution and dispersed. The ultrasonic dispersion treatment is further continued for 60 seconds. Note that, in the ultrasonic dispersion treatment, the temperature of water in the water vessel is appropriately controlled to fall within a range of 10° C. or more and 40° C. or less.

(6) To the beaker (1) having a circular bottom set up on the sample stand, the aqueous electrolyte solution (5) having a toner particle dispersed therein is added dropwise by use of a pipette to control the measurement concentration to be about 5%. Measurement is continuously carried out until the number of particles reaches 50,000.

(7) Measurement data is analyzed by the dedicated software attached to the apparatus and a weight average particle diameter (D4) and a number average particle diameter (D1) are computationally obtained. Note that, the weight average particle diameter (D4) is displayed as the "mean diameter" in the screen of "analysis/volume statistical value (arithmetic mean)" when "graph/volume %" is selected in the dedicated software; whereas the number average particle diameter (D1) is displayed as the "mean diameter" in the screen of "analysis/number statistical value (arithmetic mean)" when "graph/number %" is selected in the dedicated software.

(8) The value (% by volume) of particles having a diameter larger than 12.7 μm in the analysis data (7) is regarded as the amount of coarse particles.

(9) The value of D4/D1 obtained by dividing D4 by D1 in the analysis data (7) is regarded as a particle size distribution.

EXAMPLES

Now, the present invention will be more specifically described below by way of Production Examples and Examples; however, these Examples should not be construed as limiting the present invention.

<Synthesis of Polyester 1 Having Both Unsaturated Ends>

A two-neck flask heated to dry was charged with the following materials while introducing nitrogen.

| | |
|---|---|
| 1,6-Hexanediol | 75.0 parts by mass |
| Sebacic acid | 125.0 parts by mass |
| Dibutyltin oxide | 0.1 part by mass |

After the atmosphere in the flask was replaced with nitrogen by pressure reducing operation, the materials were stirred at 180° C. for 6 hours. Thereafter, the reaction mixture was gradually increased in temperature under reduced pressure up to 230° C. while continuously stirring, and further maintained at the same temperature for 2 hours. When reached a viscous state, the reaction mixture was cooled in air to terminate the reaction. In this manner, a polyester having a hydroxy group at both ends was synthesized. Thereafter, 150.0 parts by mass of tetrahydrofuran were added to the reaction mixture and dissolved, and then 4.8 parts by mass of triethylamine were added. After that, 7.2 parts by mass of acryloyl chloride were slowly added dropwise to the reaction mixture placed in an ice bath. After completion of dropwise addition, the reaction mixture in the ice bath was stirred for 3 hours and further stirred for 2 hours. The solvent was distilled off and re-precipitation with methanol was carried out to obtain polyester 1 having both unsaturated ends. The physical properties of polyester 1 having both unsaturated ends are shown in Table 1.

<Synthesis of Polyesters 2 to 8 Having Both Unsaturated Ends>

Polyesters 2 to 8 having both unsaturated ends were synthesized in the same manner as in the synthesis of polyester 1 having both unsaturated ends except that the supply amounts of materials were changed as shown in Table 1. The physical properties of polyesters 2 to 8 having both unsaturated ends are shown in Table 1. Note that, in synthesizing polyester 8 having both unsaturated ends, 1,4-butanediol was used in place of 1,6-hexanediol.

<Synthesis of Polyester 1 Having One Unsaturated End>

A two-neck flask heated to dry was charged with the following materials while introducing nitrogen.

| | |
|---|---|
| ε-Caprolactone | 200.0 parts by mass |
| Stearyl alcohol | 13.7 parts by mass |
| Dibutyltin oxide | 0.1 part by mass |

After the atmosphere in the flask was replaced with nitrogen by pressure reducing operation, the materials were stirred at 180° C. for 2 hours. Thereafter, the reaction mixture was gradually increased in temperature under reduced pressure up to 230° C. while continuously stirring, and further maintained at the same temperature for 2 hours. When reached a viscous state, the reaction mixture was cooled in air to terminate the reaction. In this manner, a polyester having a hydroxy group at one of the ends was synthesized. Thereafter, 150.0 parts by mass of tetrahydrofuran were added to the reaction mixture and dissolved, and then 12.6 parts by mass of triethylamine were added. After that, 18.9 parts by mass of acryloyl chloride were slowly added dropwise to the reaction mixture placed in an ice bath. After completion of dropwise addition, the reaction mixture in the ice bath was stirred for 3 hours and further stirred for 2 hours. The solvent was distilled off, and re-precipitation with methanol was carried out to obtain polyester 1 having one unsaturated end. The physical properties of polyester having one unsaturated end are shown in Table 1.

<Synthesis of Polyester 2 Having One Unsaturated End>

Polyester 2 having one unsaturated end was synthesized in the same manner as in the synthesis of polyester 1 having one unsaturated end except that the supply amounts of materials were changed as shown in Table 1. The physical properties of polyester 2 having one unsaturated end are shown in Table 1.

After the atmosphere in the flask was replaced with nitrogen by pressure reducing operation, the materials were stirred at 180° C. for 6 hours. Thereafter, the reaction mixture was gradually increased in temperature under reduced pressure up to 230° C. while continuously stirring, and further maintained at the same temperature for 2 hours. When reached a viscous state, the reaction mixture was cooled in air to terminate the reaction. In this manner, a crystalline polyester 1 was synthesized.

The reaction container equipped with a stirrer and a thermometer was charged with the following materials while replacing the inner atmosphere with nitrogen.

| | |
|---|---|
| Crystalline polyester 1 | 210.0 parts by mass |
| Xylylene diisocyanate (XDI) | 56.0 parts by mass |
| Cyclohexane dimethanol (CHDM) | 34.0 parts by mass |
| Tetrahydrofuran (THF) | 300.0 parts by mass |

The mixture was heated to a temperature of 50° C. and a urethane reaction was carried out for 15 hours. A solvent, THF, was distilled off to obtain a block polymer 1. Block polymer 1 had Mn of 12,300, Mw of 31,400 and a melting point of 60.1° C.

TABLE 1

| | 1,6-Hexanediol (parts by mass) | 1,4-Butanediol (parts by mass) | Sebacic acid (parts by mass) | Stearyl alcohol (parts by mass) | ε-Caprolactone (parts by mass) | Triethylamine (parts by mass) | Acryloyl chloride (parts by mass) | Mn | Mw | Mp |
|---|---|---|---|---|---|---|---|---|---|---|
| Polyester 1 having both unsaturated ends | 75.0 | — | 125.0 | — | — | 4.8 | 7.2 | 10600 | 19800 | 16000 |
| Polyester 2 having both unsaturated ends | 86.0 | — | 135.0 | — | — | 12.5 | 18.8 | 3300 | 6400 | 5300 |
| Polyester 3 having both unsaturated ends | 71.0 | — | 120.0 | — | — | 2.0 | 3.0 | 24000 | 53000 | 48000 |
| Polyester 4 having both unsaturated ends | 76.0 | — | 124.0 | — | — | 3.7 | 5.5 | 6800 | 13400 | 10500 |
| Polyester 5 having both unsaturated ends | 70.0 | — | 118.0 | — | — | 2.7 | 4.0 | 18900 | 36300 | 29000 |
| Polyester 6 having both unsaturated ends | 88.0 | — | 136.0 | — | — | 12.9 | 19.3 | 2700 | 5500 | 4500 |
| Polyester 7 having both unsaturated ends | 69.0 | — | 117.0 | — | — | 1.9 | 2.8 | 26200 | 57300 | 52000 |
| Polyester 8 having both unsaturated ends | — | 55.0 | 120.0 | — | — | 4.8 | 7.2 | 9900 | 20100 | 16000 |
| Polyester 1 having one unsaturated end | — | — | — | 13.7 | 200.0 | 12.6 | 18.9 | 4300 | 5900 | 5000 |
| Polyester 2 having one unsaturated end | — | — | — | 2.3 | 200.0 | 2.1 | 3.2 | 24200 | 34000 | 28000 |

<Synthesis of Block Polymer 1>

A two-neck flask heated to dry was charged with the following materials while introducing nitrogen.

| | |
|---|---|
| 1,6-Hexanediol | 76.0 parts by mass |
| Sebacic acid | 124.0 parts by mass |
| Dibutyltin oxide | 0.1 part by mass |

<Synthesis of Amorphous Resin 1>

The reaction container equipped with a stirrer and a thermometer was charged with the following materials while replacing the inner atmosphere with nitrogen.

| | |
|---|---|
| Styrene | 140.0 parts by mass |
| n-Butyl acrylate | 60.0 parts by mass |
| Azobisisobutyronitrile | 1.2 parts by mass |
| Toluene | 200.0 parts by mass |

The mixture was heated to a temperature of 65° and a reaction was carried out for 5 hours. Thereafter, the mixture was heated up to 80° C. and the reaction was continued for 3 hours. After the reaction mixture was cooled to room temperature and re-precipitation was performed with methanol to obtain amorphous resin 1. The obtained amorphous resin 1 had Mn of 12,000 and Mw of 20,000.

<Synthesis of Amorphous Resin 2>

A two-neck flask heated to dry was charged with the following materials while introducing nitrogen.

| | |
|---|---|
| Polyoxypropylene (2.2)-2,2-bis(4-hydroxyphenyl) propane | 30.0 parts by mass |
| Polyoxyethylene (2.2)-2,2-bis(4-hydroxyphenyl) propane | 33.0 parts by mass |
| Terephthalic acid | 21.0 parts by mass |
| Trimellitic anhydride | 1.0 part by mass |
| Dodecenylsuccinic acid | 15.0 parts by mass |
| Dibutyltin oxide | 0.1 part by mass |

After the atmosphere in the flask was replaced with nitrogen by pressure reducing operation, the materials were stirred at 200° C. for 5 hours. Thereafter, the reaction mixture was gradually increased in temperature under reduced pressure up to 230° C. while continuously stirring, and further maintained at the same temperature for 2 hours. When reached a viscous state, the reaction mixture was cooled in air to terminate the reaction. In this manner, an amorphous polyester, i.e., amorphous resin 2 was synthesized. Amorphous resin 2 had Mn of 5,200 and Mw of 23,000.

<Preparation of Resin Solutions 1 to 3>

To a beaker equipped with a stirring device, 500.0 parts by mass of acetone and 500.0 parts by mass of block polymer 1 were placed. The reaction mixture was stirred at a temperature of 40° C. until the compound was completely dissolved to prepare resin solution 1. Resin solution 2 and resin solution 3 were obtained in the same manner as above by placing amorphous resin 1 and amorphous resin 2, respectively.

<Preparation of Resin Fine Particle Dispersion Liquid 1>

A two-neck flask heated to dry was charged with the following materials and 800.0 parts by mass of toluene while introducing nitrogen. The reaction mixture was heated to 70° C. and the materials were completely dissolved to prepare a monomer composition.

| | |
|---|---|
| Polyester 1 having both unsaturated ends | 40.0 parts by mass |
| Polyester 1 having one unsaturated end | 10.0 parts by mass |

-continued

| | |
|---|---|
| Methacryl-modified organopolysiloxane (trade name: X-22-2475, manufactured by Shin-Etsu Chemical Co., Ltd., molecular weight: 420) | 25.0 parts by mass |
| Styrene | 15.0 parts by mass |
| Methacrylic acid | 10.0 parts by mass |

Note that, Methacryl-modified organopolysiloxane (X-22-2475) has a structure represented by Formula (i) where $R^2$, $R^3$ and $R^5$ each represent a methyl group; $R^4$ represents a propylene group; and n=3.

The monomer composition was cooled to 25° C. while stirring at 250 rpm and bubbled with nitrogen for 30 minutes. To this, 0.6 parts by mass of azobismethoxydimethyl valeronitrile were added as a polymerization initiator. Thereafter, the reaction mixture was heated to 75° C. and a reaction was carried out for 6 hours. The reaction mixture was further heated to 80° C. and a reaction was carried for 1 hour. Thereafter, the reaction mixture was cooled in the air to obtain a dispersion of coarse particle-like resin.

The obtained dispersion of a coarse particle-like resin was loaded in a temperature adjustable stirring tank, sent to a dispersion/grinding machine (trade name: CLEAR SS5, manufactured by M Technique Co., Ltd.) by use of a pump at a flow rate of 35 g/min and treated to obtain a dispersion of a granular resin. The treatment conditions of the dispersion by CLEAR SS5 were as follows: the circumferential velocity of the outermost periphery of a rotatory ring-shaped disk in CLEAR SS5 is 15.7 m/s; and the interval between the rotatory ring-shaped disk and a ring-shaped disk immobilized was 1.6 μm. The temperature of the stirring tank was controlled such that the temperature of the liquid treated by CLEAR SS5 reached 40° C. or less.

The resin fine particle and toluene in the dispersion were separated by a centrifugal treatment performed at 16500 rpm for 2.5 hours. Thereafter, the supernatant was removed to obtain a condensed dispersion of the resin fine particle. In a beaker equipped with a stirring device, the condensed dispersion of the resin fine particle was placed and dispersed in acetone by a high power ultrasonic homogenizer (trade name: VCX-750, manufactured by Sonics & materials). In this manner, resin fine particle dispersion liquid 1 having a solid content concentration of 10.0 mass % was prepared.

<Preparation of Resin Fine Particle Dispersion Liquids 2 to 19>

Resin fine particle dispersion liquids 2 to 19 were prepared in the same manner as in preparation of resin fine particle dispersion liquid 1 except that the types and supply amounts of materials were changed as described in Table 2.

TABLE 2

| | Monomer X | | Monomer Y | | | Styrene | Methacrylic acid |
|---|---|---|---|---|---|---|---|
| Fine resin particle dispersion liquid | Monomer | Supply amount (parts by mass) | Monomer | Supply amount (parts by mass) | Methacryl-modified organopolysiloxane Supply amount (parts by mass) | Supply amount (parts by mass) | Supply amount (parts by mass) |
| 1 | Polyester 1 having both unsaturated ends | 40.0 | Polyester 1 having one unsaturated end | 10.0 | 25.0 | 15.0 | 10.0 |
| 2 | Polyester 2 having both unsaturated ends | 20.0 | Polyester 1 having one unsaturated end | 17.0 | 25.0 | 28.0 | 10.0 |
| 3 | Polyester 3 having both unsaturated ends | 40.0 | Polyester 1 having one unsaturated end | 20.0 | 25.0 | 5.0 | 10.0 |

TABLE 2-continued

| Fine resin particle dispersion liquid | Monomer X: Monomer | Monomer X: Supply amount (parts by mass) | Monomer Y: Monomer | Monomer Y: Supply amount (parts by mass) | Methacryl-modified organopolysiloxane Supply amount (parts by mass) | Styrene Supply amount (parts by mass) | Methacrylic acid Supply amount (parts by mass) |
|---|---|---|---|---|---|---|---|
| 4 | Polyester 1 having both unsaturated ends | 11.0 | Polyester 1 having one unsaturated end | 10.0 | 25.0 | 44.0 | 10.0 |
| 5 | Polyester 4 having both unsaturated ends | 40.0 | Polyester 1 having one unsaturated end | 20.0 | 25.0 | 5.0 | 10.0 |
| 6 | Polyester 5 having both unsaturated ends | 40.0 | Polyester 1 having one unsaturated end | 20.0 | 25.0 | 5.0 | 10.0 |
| 7 | Polyester 2 having both unsaturated ends | 40.0 | Polyester 1 having one unsaturated end | 15.0 | 25.0 | 10.0 | 10.0 |
| 8 | Polyester 1 having both unsaturated ends | 40.0 | — | — | 25.0 | 25.0 | 10.0 |
| 9 | Polyester 1 having both unsaturated ends | 40.0 | Polyester 2 having one unsaturated end | 10.0 | 25.0 | 15.0 | 10.0 |
| 10 | Polyester 1 having both unsaturated ends | 40.0 | PLACCEL FA5 | 10.0 | 25.0 | 15.0 | 10.0 |
| 11 | Polyester 1 having both unsaturated ends | 40.0 | Polyester 1 having one unsaturated end | 3.0 | 25.0 | 22.0 | 10.0 |
| 12 | Polyester 1 having both unsaturated ends | 30.0 | Polyester 1 having one unsaturated end | 32.0 | 25.0 | 3.0 | 10.0 |
| 13 | Polyester 1 having both unsaturated ends | 40.0 | Light acrylate 130A | 10.0 | 25.0 | 15.0 | 10.0 |
| 14 | Polyester 6 having both unsaturated ends | 20.0 | Polyester 1 having one unsaturated end | 10.0 | 25.0 | 35.0 | 10.0 |
| 15 | Polyester 7 having both unsaturated ends | 40.0 | Polyester 1 having one unsaturated end | 20.0 | 25.0 | 5.0 | 10.0 |
| 16 | Polyester 1 having both unsaturated ends | 8.0 | Polyester 1 having one unsaturated end | 10.0 | 25.0 | 47.0 | 10.0 |
| 17 | Polyester 2 having both unsaturated ends | 48.0 | Polyester 1 having one unsaturated end | 10.0 | 25.0 | 7.0 | 10.0 |
| 18 | — | — | Polyester 1 having one unsaturated end | 6.0 | 25.0 | 59.0 | 10.0 |
| 19 | Polyester 8 having both unsaturated ends | 40.0 | Polyester 1 having one unsaturated end | 10.0 | 25.0 | 15.0 | 10.0 |

Note that, in Table 2, as methacryl-modified organopolysiloxane, X-22-2475 was used in all cases. Light acrylate 130A is a trade name of a product manufactured by KYOEISHA CHEMICAL Co., Ltd. and has a structure represented by the following formula (ii). PLACCEL FA5 is a trade name of a product manufactured by DAICEL CORPORATION and has a structure represented by the following formula (iii).

(ii)

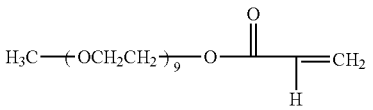

-continued (iii)

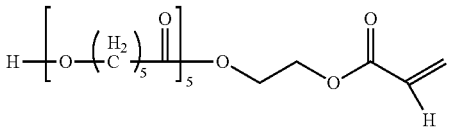

<Preparation of Colorant Dispersion Liquid>

| | |
|---|---|
| C. I. Pigment Blue 15:3 | 100.0 parts by mass |
| Acetone | 150.0 parts by mass |
| Glass beads (1 mm) | 300.0 parts by mass |

The materials mentioned above were placed in a heat resistant glass container, dispersed for 5 hours by a paint shaker (manufactured by TOYO SEIKI SEISAKU-SHO, LTD.) and filtered by a nylon mesh to remove the glass beads. In this manner, a dispersion liquid of a colorant having a volume average particle diameter of 200 nm and a solid content concentration of 40.0 mass % was obtained.

<Preparation of Wax Dispersion Liquid>

| | |
|---|---|
| Dipentaerythritol palmitate wax | 16.0 parts by mass |
| Wax dispersant (a copolymer obtained by graft copolymerization of 50.0 parts by mass of styrene, 25.0 parts by mass of n-butyl acrylate and 10.0 parts by mass of acrylonitrile in the presence of 15.0 parts by mass of polyethylene; peak molecular weight 8,500) | 8.0 parts by mass |
| Acetone | 76.0 parts by mass |

The materials mentioned above were placed in a glass beaker (manufactured by AGC TECHNO GLASS CO., LTD.) equipped with a stirring blade(s). The reaction system was heated to 50° C. to dissolve wax in acetone. Subsequently, the reaction system (mixture) was gradually cooled down to 25° C. by gently stirring at 50 rpm for 3 hours to obtain a milky liquid. The liquid was placed in a heat resistant container together with 20 parts by mass of 1-mm glass beads and dispersed by a paint shaker for 3 hours. Thereafter, the glass beads were removed by a nylon mesh to obtain a wax dispersion liquid having a volume average particle diameter of 270 nm and a solid content concentration of 24 mass %.

Example 1

<Production of Toner>

| | |
|---|---|
| Resin solution 1 | 200.0 parts by mass |
| Resin fine particle dispersion liquid 1 | 100.0 parts by mass |
| Wax dispersion liquid | 20.0 parts by mass |
| Colorant dispersion liquid | 12.0 parts by mass |

To a beaker, the materials mentioned above were placed. The reaction mixture was conditioned at a temperature of 40.0° C. and stirred by a DISPER (manufactured by PRIMIX Corporation (old name: Tokushukika Kogyou Sha) at 3000 rpm for one minute to obtain resin composition 1.

In the apparatus shown in FIGURE, granulation tank t1 was previously controlled to have an internal temperature of 45.0° C. and charged with resin composition 1. Valve V1 and pressure regulating valve V2 were closed, resin composition 1 was conditioned at a temperature of 45.0° C. while stirring the content of granulation tank t1 by stirring device S1 at a rotation rate of 300 rpm. Valve V1 was opened and carbon dioxide (purity 99.99%) was introduced from bomb B1 into granulation tank t1. When the inner pressure reached 2.0 MPa, valve V1 was closed. When the mass of carbon dioxide introduced was measured by a mass flowmeter, the mass was 250.0 parts by mass. After the interior temperature of granulation tank t1 was confirmed to be 45.0° C., the content of the tank was stirred at a rotation rate of 1000 rpm for 10 minutes. In this manner, granulation was made to prepare a dispersion. Subsequently, the rotation rate was reduced down to 300 rpm and the interior of granulation tank t1 was cooled to 23.0° C. at a cooling rate of 0.5° C./minute.

Subsequently, valve V1 was opened to introduce carbon dioxide from bomb B1 into granulation tank t1 by means of pump P1. At this time, pressure-regulating valve V2 was set at 8.0 MPa. While the inner pressure of granulation tank t1 was maintained at 8.0 MPa in this way, carbon dioxide was allowed to flow. By this operation, carbon dioxide containing an organic solvent (mainly, acetone) extracted from granulated droplets was released into solvent recovery tank t2. In this manner, the organic solvent and carbon dioxide were separated. One hour later, operation of pump P1 was terminated, valve V1 was closed and pressure-regulating valve V2 was gradually opened to reduce the inner pressure of granulation tank t1 down to the atmospheric pressure. In this manner, the toner particles trapped by filter F1 were recovered and a toner consisting of the toner particles was obtained. Physical properties of the toner are shown in Table 3.

<Evaluation Method of Toner>

The obtained toner was evaluated for amount of coarse toner particles and particle size distribution. The evaluation results are shown in Table 5. Note that, evaluation criteria are as follows.

(1) Amount of Coarse Particles

A: Amount of coarse particles is less than 0.5° by volume.

B: Amount of coarse particles is 0.5% by volume or more and less than 1.0% by volume.

C: Amount of coarse particles is 1.0% by volume or more and less 3.0% by volume.

D: Amount of coarse particles is 3.0% by volume or more.

(2) Particle Size Distribution

A: Particle size distribution is less than 1.15.

B: Particle size distribution is 1.15 or more and less than 1.20.

C: Particle size distribution is 1.20 or more and less than 1.30.

D: Particle size distribution is 1.30 or more.

Examples 2 to 15, Comparative Examples 1 to 6

Toners were prepared and evaluated in the same manner as in Example 1 except that the types and supply amounts of resins to be used were changed as shown in Table 4. The evaluation results are shown in Table 5. Note that, in Comparative Example 6, granulation was not made and a toner particle was not obtained.

TABLE 3

| | Mp of monomer X | Content of monomer X in monomer composition (% by mol) | Mp of monomer Y | Content of monomer Y in monomer composition (% by mass) | $\lvert SP_X - SP_A \rvert$ |
|---|---|---|---|---|---|
| Example 1 | 16,000 | 0.79 | 5,000 | 10.0 | 1.4 |
| Example 2 | 5,300 | 0.85 | 5,000 | 17.0 | 1.4 |
| Example 3 | 48,000 | 0.38 | 5,000 | 20.0 | 1.4 |
| Example 4 | 16,000 | 0.12 | 5,000 | 10.0 | 1.4 |
| Example 5 | 10,500 | 1.71 | 5,000 | 20.0 | 1.4 |
| Example 6 | 29,000 | 0.63 | 5,000 | 20.0 | 1.4 |
| Example 7 | 5,300 | 2.76 | 5,000 | 15.0 | 1.4 |
| Example 8 | 16,000 | 0.61 | — | 0.0 | 1.4 |
| Example 9 | 16,000 | 0.75 | 689 | 10.0 | 1.4 |
| Example 10 | 16,000 | 0.80 | 28,000 | 10.0 | 1.4 |
| Example 11 | 16,000 | 0.66 | 5,000 | 3.0 | 1.4 |
| Example 12 | 16,000 | 0.92 | 5,000 | 32.0 | 1.4 |
| Example 13 | 16,000 | 0.79 | 5,000 | 10.0 | 2.0 |
| Example 14 | 16,000 | 0.75 | 482 | 10.0 | 1.4 |
| Example 15 | 16,000 | 0.79 | 5,000 | 10.0 | 1.4 |
| Comparative Example 1 | 4,500 | 0.87 | 5,000 | 10.0 | 1.4 |
| Comparative Example 2 | 52,000 | 0.35 | 5,000 | 20.0 | 1.4 |
| Comparative Example 3 | 16,000 | 0.08 | 5,000 | 10.0 | 1.4 |

TABLE 3-continued

| | Mp of monomer X | Content of monomer X in monomer composition (% by mol) | Mp of monomer Y | Content of monomer Y in monomer composition (% by mass) | $\lvert SP_X - SP_A \rvert$ |
|---|---|---|---|---|---|
| Comparative Example 4 | 5,300 | 3.11 | 5,000 | 10.0 | 1.4 |
| Comparative Example 5 | 16,000 | 0.79 | 5,000 | 10.0 | 3.2 |
| Comparative Example 6 | — | — | 5,000 | 6.0 | — |

TABLE 4

| | Resin solution | | Fine resin particle dispersion liquid | | Wax | Colorant |
|---|---|---|---|---|---|---|
| | Resin solution | Supply amount (parts by mass) | Fine resin particle dispersion liquid | Supply amount (parts by mass) | dispersion liquid Supply amount (parts by mass) | dispersion liquid Supply amount (parts by mass) |
| Example 1 | 1 | 200.0 | 1 | 100.0 | 20.0 | 12.0 |
| Example 2 | 1 | 200.0 | 2 | 100.0 | 20.0 | 12.0 |
| Example 3 | 1 | 200.0 | 3 | 100.0 | 20.0 | 12.0 |
| Example 4 | 1 | 200.0 | 4 | 100.0 | 20.0 | 12.0 |
| Example 5 | 1 | 200.0 | 5 | 100.0 | 20.0 | 12.0 |
| Example 6 | 1 | 200.0 | 6 | 100.0 | 20.0 | 12.0 |
| Example 7 | 1 | 200.0 | 7 | 100.0 | 20.0 | 12.0 |
| Example 8 | 1 | 200.0 | 8 | 100.0 | 20.0 | 12.0 |
| Example 9 | 1 | 200.0 | 9 | 100.0 | 20.0 | 12.0 |
| Example 10 | 1 | 200.0 | 10 | 100.0 | 20.0 | 12.0 |
| Example 11 | 1 | 200.0 | 11 | 100.0 | 20.0 | 12.0 |
| Example 12 | 1 | 200.0 | 12 | 100.0 | 20.0 | 12.0 |
| Example 13 | 2 | 200.0 | 1 | 100.0 | 20.0 | 12.0 |
| Example 14 | 1 | 200.0 | 13 | 100.0 | 20.0 | 12.0 |
| Example 15 | 1 | 200.0 | 19 | 100.0 | 20.0 | 12.0 |
| Comparative Example 1 | 1 | 200.0 | 14 | 100.0 | 20.0 | 12.0 |
| Comparative Example 2 | 1 | 200.0 | 15 | 100.0 | 20.0 | 12.0 |
| Comparative Example 3 | 1 | 200.0 | 16 | 100.0 | 20.0 | 12.0 |
| Comparative Example 4 | 1 | 200.0 | 17 | 100.0 | 20.0 | 12.0 |
| Comparative Example 5 | 3 | 200.0 | 1 | 100.0 | 20.0 | 12.0 |
| Comparative Example 6 | 1 | 200.0 | 18 | 100.0 | 20.0 | 12.0 |

TABLE 5

| | Coarse particle amount | | Particle size distribution | |
|---|---|---|---|---|
| | Coarse particle amount (number %) | Evaluation | Particle size distribution | Evaluation |
| Example 1 | 0.0 | A | 1.12 | A |
| Example 2 | 0.3 | A | 1.28 | C |
| Example 3 | 2.7 | C | 1.18 | B |
| Example 4 | 2.6 | C | 1.18 | B |
| Example 5 | 0.4 | A | 1.14 | A |
| Example 6 | 0.4 | A | 1.14 | A |
| Example 7 | 0.3 | A | 1.27 | C |
| Example 8 | 0.3 | A | 1.28 | C |
| Example 9 | 0.1 | A | 1.18 | B |
| Example 10 | 0.2 | A | 1.18 | B |
| Example 11 | 0.2 | A | 1.17 | B |
| Example 12 | 0.8 | B | 1.19 | B |
| Example 13 | 0.2 | A | 1.19 | B |
| Example 14 | 0.2 | A | 1.19 | B |
| Example 15 | 0.1 | A | 1.13 | A |

TABLE 5-continued

| | Coarse particle amount | | Particle size distribution | |
|---|---|---|---|---|
| | Coarse particle amount (number %) | Evaluation | Particle size distribution | Evaluation |
| Comparative Example 1 | 0.4 | A | 1.33 | D |
| Comparative Example 2 | 3.3 | D | 1.28 | C |
| Comparative Example 3 | 3.2 | D | 1.27 | C |

TABLE 5-continued

| | Coarse particle amount | | Particle size distribution | |
|---|---|---|---|---|
| | Coarse particle amount (number %) | Evaluation | Particle size distribution | Evaluation |
| Comparative Example 4 | 0.4 | A | 1.34 | D |
| Comparative Example 5 | 0.6 | B | 1.32 | D |
| Comparative Example 6 | Not granulated | | | |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-213166, filed Oct. 29, 2015, which is hereby incorporated by reference herein in its entirety.

What is claimed is:

1. A method of producing a toner comprising a toner particle, the method comprising the steps of:

a) preparing a resin solution by mixing a resin A and an organic solvent, b) mixing the resin solution, a resin fine particle containing a resin B, and a dispersion medium to form a droplet of the resin solution whose surface has been covered with the resin fine particle, and c) removing the organic solvent in the droplet, wherein:

the resin B is a polymer of a monomer composition comprising a monomer X having polymerizable unsaturated groups at the both ends;

the monomer X has a peak molecular weight of 5,000 or more and 50,000 or less;

the content of the monomer X is 0.10% by mol or more and 3.00% by mol or less based on a total amount of monomers of the monomer composition, and the resin A and the monomer X satisfy the following formula (1), $$|SP_X - SP_A| \leq 2.0 \quad (1)$$

where $SP_A$ represents a solubility parameter of the resin A, and $SP_X$ represents a solubility parameter of the monomer X.

2. The method of producing a toner according to claim 1, wherein the monomer X has a polyester structure.

3. The method of producing a toner according to claim 1, wherein the resin B is a polymer of a monomer composition comprising, in addition to the monomer X, a monomer Y having a polymerizable unsaturated group at one of the ends.

4. The method of producing a toner according to claim 3, wherein the monomer Y has a peak molecular weight of 300 or more and 30,000 or less.

5. The method of producing a toner according to claim 3, wherein the content of the monomer Y is 5.0 mass % or more and 30.0 mass % or less based on the total amount of monomers of the monomer composition.

6. The method of producing a toner according to claim 3, wherein the monomer Y has a polyester structure.

7. The method of producing a toner according to claim 1, wherein the resin A contains a polyester.

8. The method of producing a toner according to claim 3, wherein the resin B is a polymer of a monomer composition comprising, in addition to the monomer X, an organopolysiloxane compound represented by the following formula (i)

(i)

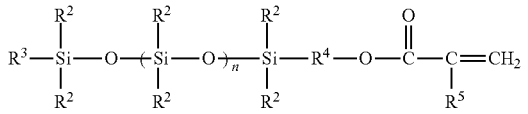

where $R^2$ and $R^3$ each represent an alkyl group; $R^4$ represents an alkylene group; $R^5$ represents a hydrogen atom or a methyl group; and n, which represents a degree of polymerization, is 2 or more.

9. The method of producing a toner according to claim 1, wherein the dispersion medium comprises carbon dioxide.

10. A method of producing a resin particle, comprising the steps of:

a) preparing a resin solution by mixing a resin A and an organic solvent, b) mixing the resin solution, a resin fine particle containing a resin B, and a dispersion medium to form a droplet of the resin solution whose surface has been covered with the resin fine particle, and c) removing the organic solvent in the droplet, wherein:

the resin B is a polymer of a monomer composition comprising a monomer X having polymerizable unsaturated groups at the both ends;

the monomer X has a peak molecular weight of 5,000 or more and 50,000 or less;

the content of the monomer X is 0.10% by mol or more and 3.00% by mol or less based on a total amount of monomers of the monomer composition; and the resin A and the monomer X satisfy the following formula (1), $$|SP_X - SP_A| \leq 2.0 \quad (1)$$

where $SP_A$ represents a solubility parameter of the resin A, and $SP_X$ represents a solubility parameter of the monomer X.

* * * * *